United States Patent [19]

Woodard et al.

[11] Patent Number: 4,541,875

[45] Date of Patent: Sep. 17, 1985

[54] CONTROLLING DISTORTION IN PROCESSED COPPER BERYLLIUM ALLOYS

[76] Inventors: Dudley H. Woodard, 35188 N. Turtle Trail, Willoughby, Ohio 44094; Lynn J. Ebert, 104 E. 197th, Euclid, Ohio 44119

[21] Appl. No.: 713,318

[22] Filed: Mar. 18, 1985

[51] Int. Cl.[4] ..... C22F 1/08

[52] U.S. Cl. ..... 148/11.5 C; 148/12.7 C

[58] Field of Search ..... 148/11.5 C, 2, 12.7 C, 148/411, 13.2, 160; 420/494

[56] References Cited

U.S. PATENT DOCUMENTS

| | | | |
|---|---|---|---|
| 2,257,708 | 9/1941 | Stott | 148/12.7 C |
| 2,412,447 | 12/1946 | Donachie | 148/411 |
| 3,138,493 | 6/1964 | Smith | 148/11.5 C |
| 3,658,601 | 4/1972 | Britton et al. | 148/12.7 C |
| 4,179,314 | 12/1979 | Wickle | 148/12.7 C |
| 4,394,185 | 7/1983 | McClelland et al. | 148/12.7 C |
| 4,425,168 | 1/1984 | Goldstein et al. | 148/12.7 C |

*Primary Examiner*—Peter K. Skiff
*Attorney, Agent, or Firm*—Hosea E. Taylor

[57] ABSTRACT

This invention provides a novel method for the production of formed parts from copper beryllium alloys. More specifically, this invention provides a process for the virtual elimination of the non-reproducible distortion which is currently experienced during the precipitation hardening of parts formed from copper beryllium alloys. To this end the process comprises a series of mechanical and thermal treatments which minimize or eliminate non-reproducible distortion by relieving or decreasing the magnitude of residual stresses throughout the various steps of the process before the formation of precipitates becomes dominant and by providing a more even patterned distribution of precipitates in the matrix of the alloy both prior to and after a thermal aging process. Additionally, the implementation of this process in conjunction with a precipitation hardening treatment utilizing a molten salt bath heating medium results in an alloy which exhibits an increased elongation in tandem with an increased proportional limit.

29 Claims, No Drawings

CONTROLLING DISTORTION IN PROCESSED COPPER BERYLLIUM ALLOYS

FIELD OF THE INVENTION

This invention relates to the processing of copper beryllium alloys. More specifically, this invention relates to reducing the amount of geometric distortion currently observed during the precipitation hardening of formed parts in the conventional processing of copper beryllium alloys.

BACKGROUND OF THE INVENTION

The prior art reveals various methods for decreasing the distortion which results during the precipitation hardening of formed parts produced from copper beryllium alloys. Unfortunately, these prior art methods are minimally effective and often fail to control the resultant distortion to a commercially acceptable degree. Additionally, the prior art methods yield inconsistent non-reproducible results. These alloys are used in electrical connectors where consistent dimensional and mechanical properties in the finished product are important.

Basically, all prior art methods for producing formed parts from copper beryllium alloys include the combination of the following sequence of processing events: preparing a copper beryllium melt; casting the melt; hot working the cast copper beryllium; solution annealing the copper beryllium; cold working the solution annealed copper beryllium; forming the copper beryllium; and age-hardening the formed copper beryllium. As mentioned above, various methods have been developed in an attempt to control the distortion experienced in this processing sequence.

In this connection, reference is made to the methods disclosed in Goldstein U.S. Pat. No. 4,425,168, McClelland U.S. Pat. No. 4,394,185, Wickle U.S. Pat. No. 4,179,314, Shapiro U.S. Pat. No. 3,882,712, Britton U.S. Pat No. 3,658,601, the article entitled "Residual Stresses in Copper-2% Beryllium Alloy Strips", authored by K. E. Amin and S. Ganesh, *Experimental Mechanics,* December 1981, page 474, and the article entitled "A Technique For Predicting Distortion And Evaluating Stress Relief In Metal Forming Operations", authored by K. E. Amin and R. M. Rusnak, *Journal of Metals,* February 1981.

The methods disclosed in these prior art sources are only partially successful in eliminating distortions in finished products. Amin and Ganesh have correctly identified residual stresses as one of the sources of distortion. Amin and Ganesh have also shown that a high rolling reduction of copper beryllium strip results in tensile residual stresses near the surface of the strip and compressive residual stresses at the center of the strip while low rolling reductions result in the opposite location of these stresses within the strip.

The McClelland and the Britton patents comprehend the importance of relieving residual stresses prior to the forming operation by the incorporation of a pre-aging technique. However, they fail to realize that in a thermal treatment such as their pre-aging technique two reactions occur simultaneously. On the one hand thermal treatments such as pre-aging promote the nucleation and growth of the precipitates formed during precipitation hardening. On the other hand these treatments also reduce the magnitude of the existing cold working and residual stress patterns that affect the precipitation hardening. The recognition of these competing mechanisms is critical in the development of reproducible softening and hardening techniques and the effects thereof on the reproducibility of the formed parts. All thermal treatments must utilize those combinations of times and temperature which relieve or decrease the magnitude of residual stresses before the formation of precipitates become dominant.

None of the prior art teachings recognize that the rates at which the nucleation and growth of precipitates occur are different when the metal matrix is aged under tensile residual stresses as opposed to compressive residual stresses. The realization of the existence of these differential zones of nucleation and growth is critical in the development of a process for producing distortion free copper beryllium products since consistent and reproducible mechanical and dimensional properties can only be obtained from the aging process in coils of strip, wire and the like, and parts formed therefrom by combinations of thermal and mechanical treatments that yield consistent and reproducible stress and precipitate patterns. The possible existence of these patterns of undissolved precipitates or precipitate nuclei has not heretofore been considered.

Furthermore, to date there has been no application of the effects of light and heavy reductions to the controlling and leveling out of residual stresses within the alloy or to the modification of precipitate patterns left after an incomplete solution anneal.

SUMMARY OF THE INVENTION

With the foregoing in mind it is a principal object of this invention to provide a process for relieving the magnitude of residual stresses in copper beryllium alloys before the formation of precipitates becomes the dominant mechanism.

Another object of this invention is to provide a process for imposing on regions of compressive or tensile residual stress those tensile or compressive stresses that are of the opposite type.

Yet another object of this invention is to provide a process for ensuring an even distribution of precipitates throughout the alloy.

Still another object of this invention is to provide a process which will result in a copper beryllium alloy wich exhibits an increased proportional limit in tandem with an increased elongation.

A further object of this invention is to provide a process for the virtual elimination of the non-reproducible distortion which is currently experienced during the production of formed parts from copper beryllium alloys.

These and other objects of the present invention may be achieved by including in the prior art process for producing formed parts from a copper beryllium alloy the additional improved steps of: subjecting the alloy to a heavy rolling reduction of at least 45% during the final cold rolling pass, solution annealing the alloy, subjecting the alloy to a low rolling reduction of from 5% to 15%, once again solution annealing the alloy, precipitation hardening the alloy in a salt bath heating medium at a temperature of from 300° to 800° for a period of up to 180 minutes, and when possible reversing the direction of coiling during each of the various steps of the process.

To the accomplishment of the foregoing and related ends the invention, then, comprises the features hereinafter fully described and particularly pointed out in the claims, the following description setting forth in detail certain illustrative embodiments of the invention, these being indicative, however, of but a few of the various ways in which the principles of the invention may be employed.

DESCRIPTION OF PREFERRED EMBODIMENT

In copper beryllium alloys abnormally large strain or coherency stress fields develop during precipitation hardening. The applicants have found that these coherency stress fields may interact with the residual stress patterns that exist at the start of the thermal aging process to create unexpectedly strong effects on the dimensional changes which occur in the parts during the age hardening treatment.

Residual stresses, both compressive and tensile, are created in wire and strip during the various forming operations such as rolling, coiling, uncoiling, and the like. In an attempt to better understand the effects of these various forming operations and the resultant stresses which these operations impart into the alloy, tests were conducted in which segments of copper beryllium strip were bent around an anvil of a specific radius of curvature and then aged. Upon aging, the angle formed by the bent strip was found to change. The effects of altering the radius of the anvil, the angle of the bend, the side of the strip being put under compression, the thickness of the strip, and the thermal treatment given the strip prior to aging, were all studied and the results statistically evaluated. The evaluations revealed that on aging, the amount of shrinkage in regions that were under compressive residual stress was greater than the amount of shrinkage that occurred in regions that were under tensile residual stress.

These observations when combined with the well documented fact that large shrinkages occur in formed copper beryllium parts during aging due to the nucleation and growth of precipitates led the applicants to the conclusion that upon thermal aging the rate of nucleation and growth of precipitates in regions that are under compressive residual stress is greater than the rate that exists in regions that are under tensile residual stress. Therefore, during the aging of a formed part which contains various regions of compressive and tensile residual stresses, the formation of precipitates will proceed at different rates in each of these types of regions resulting in different amounts of shrinkage from region to region and thus will create distortion.

Conventional processing steps to aging (i.e., cold rolling, drawing, coiling and the like) produce residual stress patterns. Since residual stress patterns exist before aging and since these patterns affect precipitate nucleation and growth, precipitation patterns must be created by aging. In these precipitation patterns the original compressive stress regions would have more precipitates than the original tensile stress regions and the greater the difference in the number of precipitates in such regions, the greater would be the difference in the rates of work hardening. Similarly it is to be expected that subsequent to a solution anneal there will be more undissolved precipitates and precipitate nuclei in regions that were originally under compressive residual stress than in regions that were under tensile residual stress.

Additionally, since the distribution of residual stresses within the alloy directly affects the distribution of precipitates upon thermal treatment, an even distribution of the residual stresses which are imparted by the various forming operations of the process such as coiling would be most desirable.

Evidence of the existence of precipitate patterns was supported by data obtained from tests performed on coils of copper beryllium wire. During these tests, it was observed that in the coils of wire some portions of the coils had abnormally high rates of work hardening. The existence of these portions of the wire which had abnormally high rates of work hardening could only be explained by variations in the amount of precipitates that existed along the length of the wire. These tests also revealed that when coils drawn from the same original rod were given a severe cold reduction, annealed, given a slight cold reduction, and then annealed again, there were no portions that revealed high work hardening rates either before or after aging. This meant that the distribution of precipitates was more even within the alloy and that the periodic pattern of regions, in which large amounts of precipitates dominated, no longer existed.

These test results can be explained as follows: after the heavy reduction and the first anneal there were fewer undissolved precipitates and precipitate nuclei left on the outside of the wire than on the inside. After the light reduction and the second anneal there were fewer undissolved precipitates and precipitate nuclei left on the inside of the wire than on the outside. By successively combining the light and heavy reductions and their respective anneals a relatively homogeneous distribution of undissolved precipitates and nuclei was achieved within the wire. This was confirmed by a statistical analysis of the mechanical properties of wire which had been given the aforementioned light and heavy reductions and double anneals. These wires exhibited much less deviation than wire which was simply given one anneal and revealed no abnormal values as is commonly found in wire given only one anneal.

In an attempt to further understand and develop methods for controlling the detrimental effects of the precipitate patterns additional tests were conducted. In one of these tests two contiguous segments of 25 alloy wire were given a severe cold reduction, annealed, given a slight cold reduction, and then annealed. The segments were then drawn into the quarter-hard condition and separate lengths were aged in either an air atmosphere furnace or a salt bath at 600° F. prior to being water quenched. The tensile data obtained from these specimens is shown below:

TABLE I

| Time | Proportional Limit (KSI) | | Elongation (Percent) | |
|---|---|---|---|---|
| (Minutes) | Furnace | Salt | Furnace | Salt |
| 0 | 74.2 | | 10.1 | |
| 2 | 76.9 | 73.1 | 9.8 | 22.0 |
| 5 | 85.8 | 79.0 | 8.3 | 17.5 |
| 10 | 108.0 | 98.4 | 6.3 | 12.8 |
| 15 | 132.9 | 131.5 | 1.8 | 8.2 |
| 2 and 15* | | 118.5 | | 6.6 |

*Two minutes in the salt bath followed by a water quench and 15 additional minutes in the salt bath.

Analysis of these results shows that the furnace aging was totally ineffective in improving the elongation of the wire. However, for the wire that was quickly heated in the salt bath, two minutes was long enough to decrease the residual stresses and the cold work put in the wire by the quarter-hard reduction with the result that the elongation was more than doubled from 10.1 to 22.0.

After two minutes, however, the precipitation phenomena became dominant and strengths began to increase and elongations began to drop. After ten minutes in the salt bath, the wire revealed more elongation than it had originally shown before aging and a 32.7% increase in the proportional limit. Therefore, clearly a hardening treatment of four to eight minutes in a 600° F. molten salt bath will increase the formability of the wire as well as the strength of the wire. Similar decreases in the proportional limit were observed in specimens treated in a salt bath at 500° F. for less than 15 minutes and at 700° F. for less than 45 seconds.

The consistent and striking variations in the data of Table I were not found in wire that had been given the standard wire drawing treatment. Therefore, the results of Table I can only be attained by adopting the present invention for the processing of copper beryllium alloys, (i.e., a severe cold reduction, an anneal, a light cold reduction, an anneal). This process controls residual stress and precipitation patterns enabling the results shown in Table I and also the reduction of the distortion which results from such patterns upon aging.

Since many commercially available grades of copper beryllium alloys contain cobalt beryllides, the effects of these beryllides on this invention must be considered. The effects of cobalt beryllides on the physical properties of a copper beryllium alloy are well known. Specifically, it is known that the size and distribution of these cobalt beryllide precipitates have an appreciable effect on the rate of cold working. Therefore, cobalt beryllides must also have an effect on the combinations of time and temperature that are needed to stress relieve the alloy. Thus, it will be appreciated that in the application of this invention times and temperatures may have to be adjusted to accommodate the particular size and distribution of cobalt beryllides in the alloy which one is processing.

In summary, the invention will conform to the four basic approaches which are designed to minimize the non-reproducible distortion which results from the aging process and produce a copper beryllium alloy with improved elongations in tandem with increased proportional limits. These four basic approaches are as follows: (1) utilize combinations of time and temperature which relieve or decrease the magnitude of residual stresses before the formation of precipitates becomes dominant; (2) before aging, provide for a more even distribution of residual stresses by imposing on regions of compressive or tensile residual stresses those tensile or compressive stresses that are of the opposite type; (3) utilize those combinations of reductions and annealing that minimize the differences in the magnitudes of the precipitate patterns left from the original cold rolling operations; (4) during the age hardening process utilize a salt bath treatment with those combinations of time and temperature that give increased elongations in conjunction with increased proportional limits.

These four approaches when integrated into the prior art process of producing formed parts from copper beryllium alloys manifest themselves in a series of mechanical and thermal processes. Specifically, in order to minimize all previous precipitation patterns within the alloy and provide an even distribution of precipitates and nuclei a double anneal process is employed. The double anneal process comprises the steps of subjecting the alloy on the final cold rolling pass to a minimum cold reduction of 45% followed by a solution anneal, a light cold reduction of between 5% and 15%, and another solution anneal. When precipitation hardening the alloy, either before or after the forming operation, a molten salt bath heating medium in combination with specific times and temperatures must be employed in order to attain increased elongations in tandem with increased proportional limits. Such combinations of times and temperatures ±25° F. which have been found effective are 400° F. for a period of from two to three hours, 500° F. for a period of from thirty to sixty minutes, 600° F. for a period of from four to eight minutes, and 700° F. for a period of from one to three minutes.

The imposition on regions of compressive or tensile residual stress of those stresses of the opposite type is generally accomplished by reversing the sides of the strip during the various coiling operations of the process. Such reversing will decrease the magnitude of the resultant stresses and tend to equalize them over the entire thickness of the strip. Similarly, it will be appreciated that this concept is also applicable to wire and may be implemented simply by reversing the direction of winding at each of the reeling operations.

In processes which include an operation such as slitting prior to forming it will be necessary to stress relieve the alloy both before and after such an operation so as to avoid the detrimental effects of the stresses imparted into the alloy by the operation. The stress relief process will require a salt bath heating medium in combination with specific times and temperatures that relieve the magnitude of residual stresses before the formation of precipitates becomes dominant. Such combinations of times and temperatures ±25° F. which have been found effective are 500° F. for a period of from twelve to twenty minutes, 600° F. for a period of from sixty to ninety seconds, and 700° F. for a period of from thirty to fifty seconds. It should be noted that the incorporation of the stress relief anneals may require a light rolling reduction of up to 15% subsequent to the last stress relief anneal so as to impart some stiffness and the ability to be precipitation hardened into the alloy and thus facilitate its handling and feeding in subsequent operations.

It will be appreciated that this invention is wholly applicable to all processes for producing formed parts from copper beryllium alloy rod, wire, sheet, or the like which include the cold working or cold reduction of the alloy. Cold working may be accomplished by various methods such as rolling, stretching, or drawing.

It will be appreciated that the combinations of times and temperatures set forth in this invention simply represent guidelines and that in light of the teachings of this invention one skilled in the art may derive a variety of functional times and temperatures. Additionally, the optimum combination of times and temperatures will be a function of numerous variables such as strip or wire configuration, heat sources, alloy composition, line speed, etc.

It will also be appreciated that this invention may be easily modified to incorporate additional processing steps such as machining, broaching, or the like.

Additionally, it will be appreciated that one skilled in the art may easily adapt the invention so as to produce a finished part which exhibits a particular set of physical properties.

Finally, it will be appreciated that the application of only a portion of this invention will yield beneficial results; however, optimum results will be achieved by incorporating all portions of the invention.

We claim:

1. In a process for producing formed parts from copper beryllium alloys, which process includes the steps of:

preparing a copper beryllium alloy melt; casting the alloy melt; hot working the cast alloy; solution annealing the alloy; passing the solution annealed alloy through one or more cold-working steps; forming the alloy into a part; and precipitation hardening the formed alloy; the improved process comprising the steps of:

subjecting the alloy on the final cold-working pass to a minimum cold reduction of 45% followed by a primary solution anneal and subjecting the alloy to a light cold reduction of between 5% and 15% followed by a secondary solution anneal.

2. A process according to claim 1, wherein said process includes at least two coiling operations and the direction of coiling as between each of said coiling operations is reversed.

3. In a process for producing formed parts from copper beryllium alloys, which process includes the steps of:

preparing a copper beryllium alloy melt; casting the alloy melt; hot working the cast alloy; solution annealing the alloy; passing the solution annealed alloy through one or more cold-working steps; forming the alloy into a part; and precipitation-hardening the formed alloy; the improved process comprising the steps of:

subjecting the alloy on the final cold-working pass to a minimum cold reduction of 45% followed by a primary solution anneal, subjecting the alloy to a light cold reduction of between 5% and 15% followed by a secondary solution anneal, and subjecting the alloy to a precipitation hardening treatment in a molten salt bath heating medium at a temperature of from 375° to 725° F. for a period of up to three hours prior to part formation.

4. A process according to claim 3, wherein said precipitation hardening treatment temperature is from 375° to 425° F. for a period of from 120 to 180 minutes.

5. A process according to claim 3, wherein said precipitation hardening treatment temperature is from 475° to 525° F. for a period of from thirty to sixty minutes.

6. A process according to claim 3, wherein said precipitation hardening treatment temperature is from 575° to 625° F. for a period of from four to eight minutes.

7. A process according to claim 3, wherein said precipitation hardening treatment temperature is from 675° to 725° F. for a period of from one to three minutes.

8. In a process for producing formed parts from copper beryllium alloys, which process includes the steps of:

preparing a copper beryllium alloy melt; casting the alloy melt; hot working the cast alloy; solution annealing the alloy; passing the solution annealed alloy through one or more cold-working steps; forming the alloy into a part; and precipitation-hardening the formed alloy; the improved process comprising the steps of:

subjecting the alloy on the final cold-working pass to a minimum cold reduction of 45% followed by a primary solution anneal, subjecting the alloy to a light cold reduction of between 5% and 15% followed by a secondary solution anneal, subjecting the alloy to a precipitation hardening treatment in a molten salt bath heating medium at a temperature of from 375° to 725° F. for a period of up to three hours subsequent to part formation.

9. A process according to claim 8, wherein said precipitation hardening treatment temperature is from 375° to 425° F. for a period of from 120 to 180 minutes.

10. A process according to claim 8, wherein said precipitation hardening treatment temperature is from 475° to 525° F. for a period of from thirty to sixty minutes.

11. A process according to claim 8, wherein said precipitation hardening treatment temperature is from 575° to 625° F. for a period of from four to eight minutes.

12. A process according to claim 8, wherein said precipitation hardening treatment temperature is from 675° to 725° F. for a period of from one to three minutes.

13. In a process for producing formed parts from a copper beryllium alloy, which process includes the steps of:

preparing copper beryllium alloy melt; casting the alloy melt; hot working the cast alloy; solution annealing the alloy; passing the solution annealed alloy through one or more cold-working steps; slitting the alloy to a desired width; forming the alloy into a part; and precipitation hardening the formed alloy; the improved process comprising the steps of:

subjecting the alloy on the final cold-working pass to a minimum cold reduction of 45% followed by a primary solution anneal, subjecting the alloy to a light cold reduction of between 5% and 15% followed by a secondary solution anneal, subjecting the alloy to a first stress relief anneal in a molten salt bath medium at temperature of from 475° to 725° F. for a period of up to twenty minutes prior to slitting, and subjecting the alloy to a second stress relief anneal in a molten salt bath medium at a temperature of from 450° to 750° F. for a period of up to twenty minutes subsequent to slitting.

14. A process according to claim 13, further including the step of subjecting the alloy to a 5% to 15% cold reduction after performing said step of a second stress relief anneal so as to impart some stiffness into the alloy thus facilitating the handling and the feeding of the alloy in subsequent processes.

15. A process according to claim 13 wherein said first stress relief anneal temperature is from 475° to 525° F. for a period of twelve to twenty minutes.

16. A process according to claim 13 wherein said first stress relief anneal temperature is from 575° to 625° F. for a period of from one to two and one-half minutes.

17. A process according to claim 13 wherein said first stress relief anneal temperature is from 675° to 725° F. for a period of from thirty to fifty seconds.

18. A process according to claim 13, wherein said second stress relief anneal temperature is from 475° to 525° F. for a period of twelve to twenty minutes.

19. A process according to claim 13, wherein said second stress relief anneal temperature is from 575° to 625° F. for a period of from one to two and one-half minutes.

20. A process according to claim 13, wherein said second stress relief anneal temperature is from 675° to 725° F. for a period of from thirty to fifty seconds.

21. In a process for producing formed parts from copper beryllium alloys, which process includes the steps of:

preparing a copper beryllium alloy melt; casting the alloy melt; hot working the cast alloy; solution annealing the alloy; passing the solution annealed alloy through one or more cold-working steps; forming the alloy into a part; and precipitation hardening the formed alloy; the improved process comprising the steps of:

subjecting the alloy on the final cold-working pass to a minimum cold reduction of 45% followed by a primary solution anneal, subjecting the alloy to a light cold reduction of between 5% and 15% followed by a secondary solution anneal, subjecting the alloy to a first precipitation hardening treatment in a molten salt bath heating medium at a temperature of from 375° to 725° F. for a period of up to three hours prior to part formation, and subjecting the alloy to a second precipitation hardening treatment in a molten salt bath heating medium at a temperature of from 375° to 725° F. for a period of up to three hours.

22. A process according to claim 21, wherein said first precipitation hardening treatment temperature is from 375° to 425° F. for a period of from 120 to 180 minutes.

23. A process according to claim 21, wherein said first precipitation hardening treatment temperature is from 475° to 525° F. for a period of from thirty to sixty minutes.

24. A process according to claim 21, wherein said first precipitation hardening treatment temperature is from 575° to 625° F. for a period of from four to eight minutes.

25. A process according to claim 21, wherein said first precipitation hardening treatment temperature is from 675° to 725° F. for a period of from one to three minutes.

26. A process according to claim 21, wherein said second precipitation hardening treatment temperature is from 375° to 425° F. for a period of from 120 to 180 minutes.

27. A process according to claim 21, wherein said second precipitation hardening treatment temperature is from 475° to 525° F. for a period of from thirty to sixty minutes.

28. A process according to claim 21, wherein said second precipitation hardening treatment temperature is from 575° to 625° F. for a period of from four to eight minutes.

29. A process according to claim 21, wherein said second precipitation hardening treatment temperature is from 675° to 725° F. for a period of from one to three minutes.

* * * * *